US008591079B2

(12) United States Patent
Chang

(10) Patent No.: US 8,591,079 B2
(45) Date of Patent: Nov. 26, 2013

(54) LED CEILING LAMP

(75) Inventor: Shao-Han Chang, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 137 days.

(21) Appl. No.: 13/076,449

(22) Filed: Mar. 31, 2011

(65) Prior Publication Data

US 2012/0106134 A1 May 3, 2012

(30) Foreign Application Priority Data

Oct. 28, 2010 (CN) ..... 2010 1 0523227

(51) Int. Cl.
*F21S 8/06* (2006.01)

(52) U.S. Cl.
USPC ..... 362/408; 362/311.06

(58) Field of Classification Search
USPC ..... 362/404, 408, 240, 241, 147, 249.01, 362/249.02, 249.14–249.16, 339, 311.06, 362/311.13
See application file for complete search history.

(56) References Cited

U.S. PATENT DOCUMENTS

| | | | | |
|---|---|---|---|---|
| 6,494,601 | B2 * | 12/2002 | Johnson | 362/406 |
| 6,951,415 | B2 * | 10/2005 | Amano et al. | 362/520 |
| 7,560,745 | B2 * | 7/2009 | Kim et al. | 257/98 |
| 7,637,639 | B2 * | 12/2009 | Epstein | 362/311.02 |
| 2008/0089062 | A1 * | 4/2008 | Vennetier et al. | 362/241 |
| 2008/0123349 | A1 * | 5/2008 | Chaves et al. | 362/329 |
| 2008/0158881 | A1 * | 7/2008 | Liu et al. | 362/245 |

* cited by examiner

*Primary Examiner* — Julie Shallenberger
(74) *Attorney, Agent, or Firm* — Altis & Wispro Law Group, Inc.

(57) ABSTRACT

An LED ceiling lamp includes a primary illumination unit and at least one subsidiary illumination unit. The primary illumination includes a base and a connecting member to fix the base to a ceiling. Each of the at least one subsidiary illumination unit is fixed to the base and faces the ceiling. Each of the at least one subsidiary illumination unit comprises a circuit board with an LED unit, a lens and a reflector. The lens covers the circuit board. The circuit board and the lens are received in the reflector. The lens is configured for dividing the light beams from the LED units into several light groups. An aphotic area is formed between each two adjacent light groups. The reflector is configured for reflecting the several light groups on the ceiling.

5 Claims, 6 Drawing Sheets

LED CEILING LAMP

BACKGROUND

1. Technical Field

The present disclosure relates to LED illumination devices, especially to an LED ceiling lamp.

2. Description of Related Art

Compared to traditional light sources, light emitting diodes (LEDs) have many advantages, such as high luminous efficiency, low power consumption, and long service life. LED lights are widely used in many applications, such as LED ceiling lamp. Because the light emitting diodes are small and have a narrow light emitting angle, the LED ceiling lamp does not form a shaped light beam on a ceiling board such as quartz lamps.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
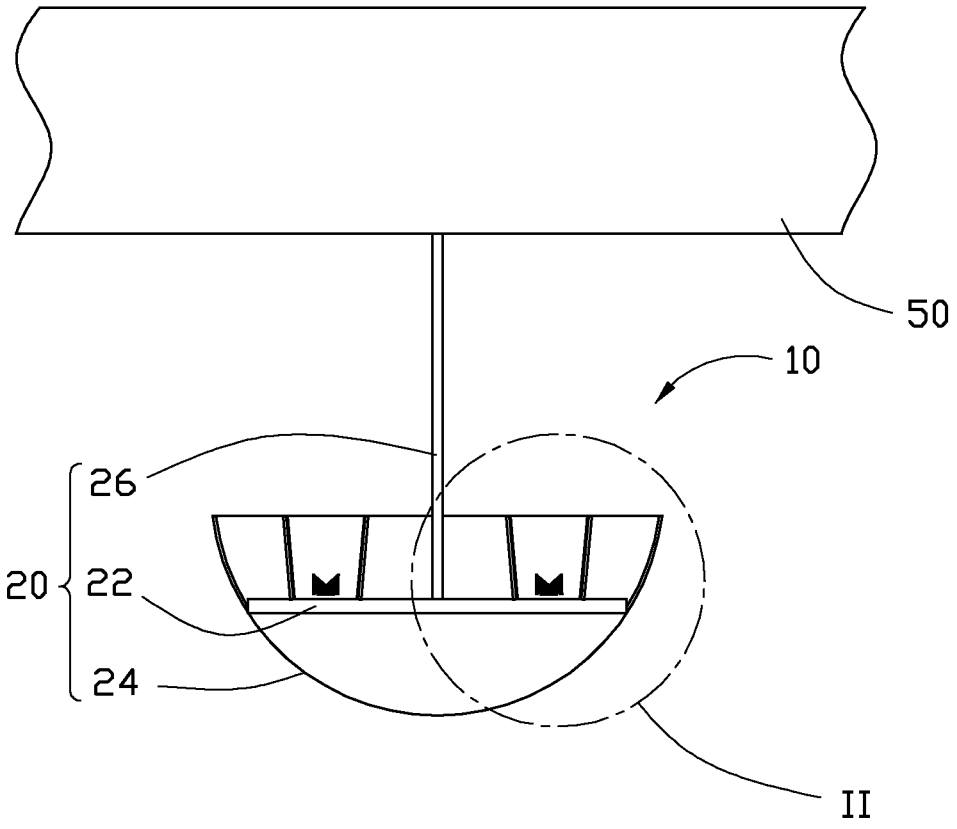
FIG. 1 is an isometric view of an LED ceiling lamp according to an exemplary embodiment.
Figure 2:
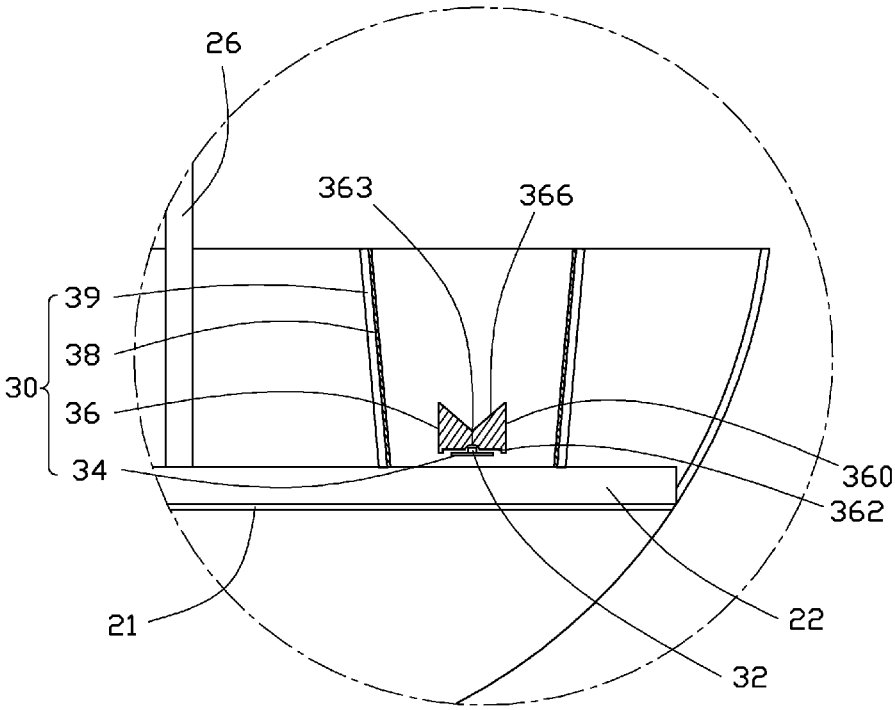
FIG. 2 is an enlarged view of the encircled portion II of FIG. 1.

Referring to FIGS. 1 and 2, an LED ceiling lamp 10 according to an exemplary embodiment includes a primary illumination device 20 and a number of subsidiary illumination devices 30 fixed to the primary illumination device 20.

The primary illumination device 20 includes a base 22, an lampshade 24 and a connecting member 26. The lampshade 24 is fixed to the base 22. The connecting member 26 is used to fix the base 22 to a ceiling 50. The base 22 includes a first circuit board 21 with a plurality of first LED units spaced from a center of the base 22. The light beams emitting from the first LED units pass through the lampshade 24 for illumination.

The subsidiary illumination devices 30 are fixed to the base 22 and face the ceiling 50. The subsidiary illumination devices 30 are symmetrically surrounding the connecting member 26. Each subsidiary illumination device 30 includes a second circuit board 34 with a second LED unit 32, a lens 36, a hollow reflector 38, and a protecting case 39. The second circuit board 34, the lens 36, the reflector 38, and the protecting case 39 can be fixed to the base 22 by screws. The protecting case 39 surrounds the reflector 38 to protect the reflector 38. The second circuit board 34 and the lens 36 are both received in the reflector 38. The lens 36 covers the second circuit board 34.

Figure 3:
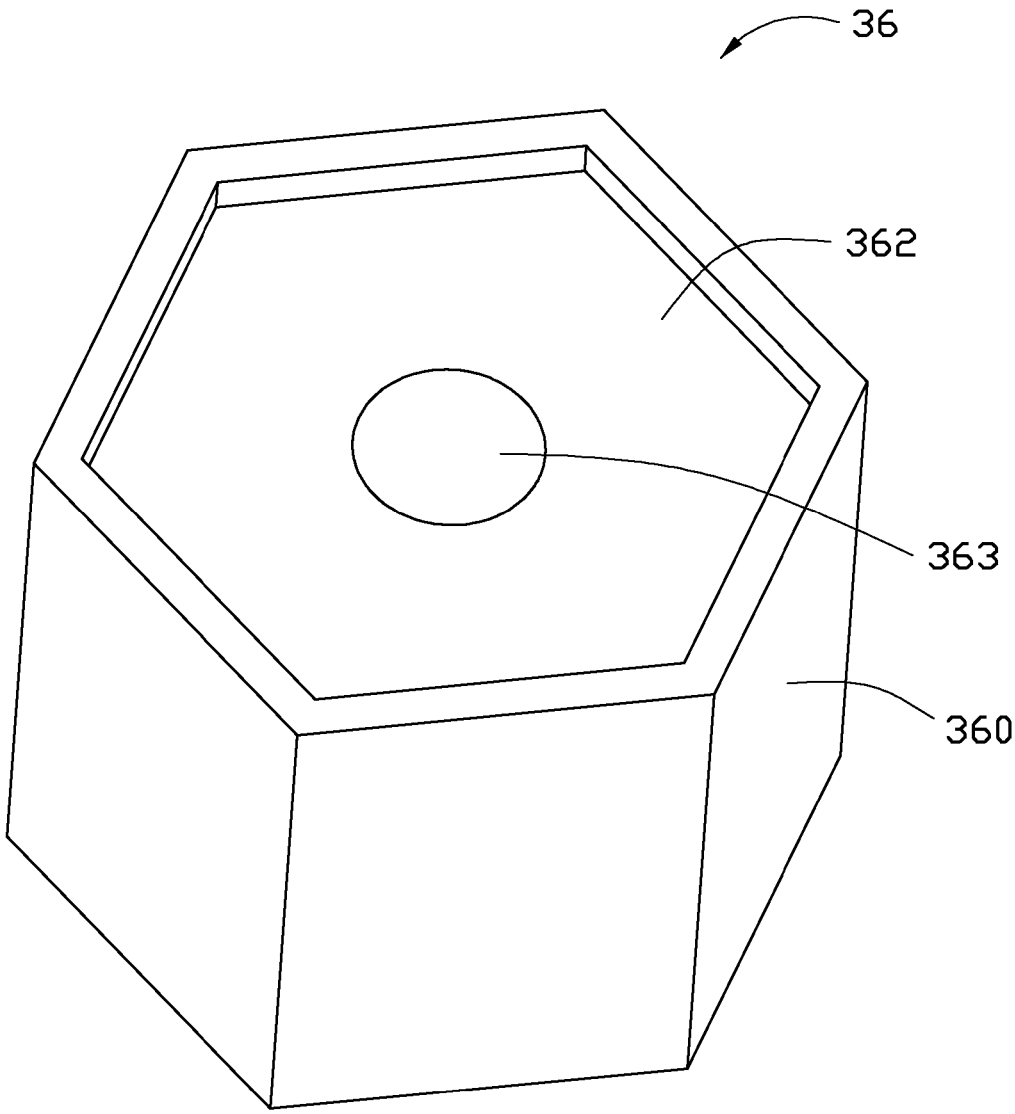
FIG. 3 is an isometric view of a lens of the LED ceiling lamp in FIG. 1.
Figure 4:
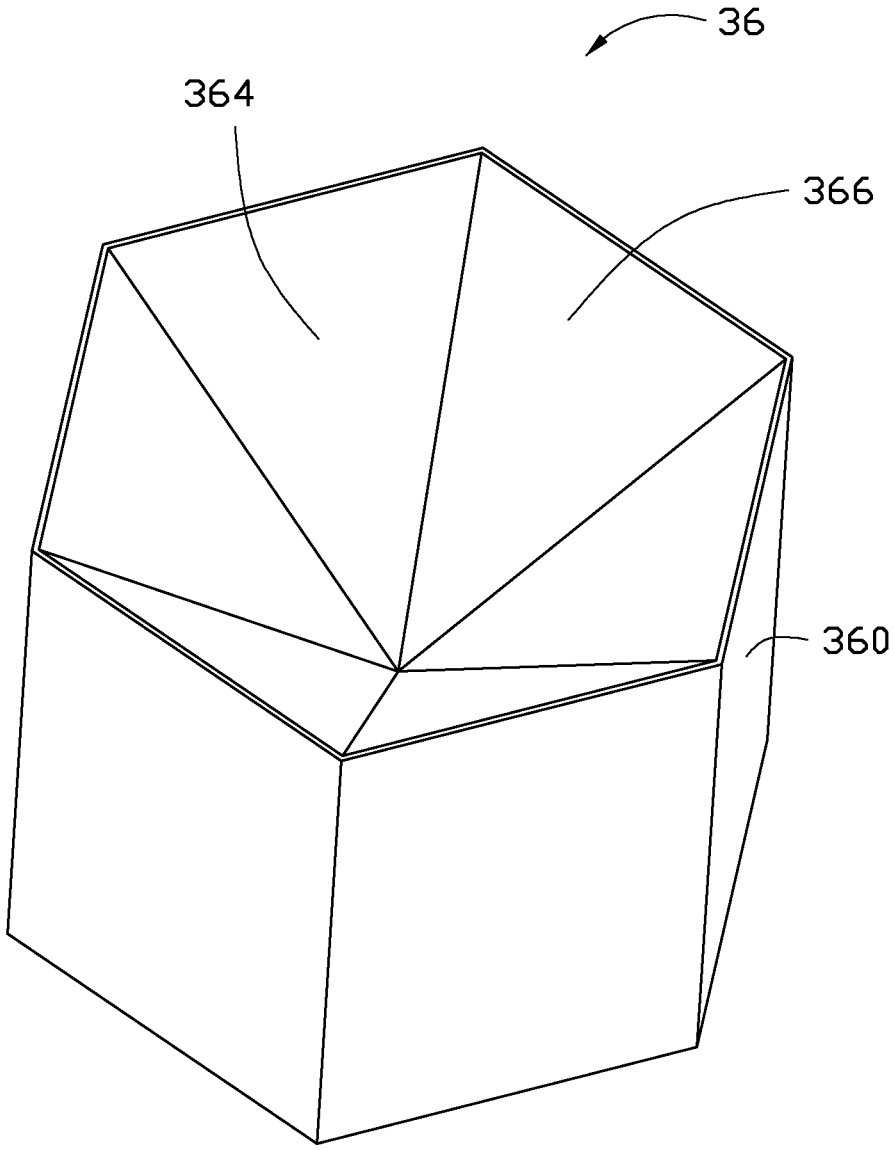
FIG. 4 is similar to FIG. 3, but viewed from another viewpoint.

Referring to FIGS. 3 and 4, the lens 36 is a polyhedron prism and includes a number of light emitting surfaces 360 for focusing the light beams. The lens 36 defines a recess 362 and a cavity 363 in the recess 362, which both face the circuit board 34. The recess 362 is configured for receiving the second circuit board 34. The cavity 363 is configured for receiving the second LED unit 32. The cavity 363 is semicircle arc-shaped to focus the light beams from the second LED unit 32. The lens 36 further defines an indentation 364 at the end of the lens 36 away from the second circuit board 34. The indentation 34 is formed with a number of inclined reflecting surfaces 366. The reflecting surfaces 366 may have the same shape and the same curve. In an alternative embodiment, the reflecting surfaces 366 can also have different shapes and different curves. The reflecting surfaces 366 are configured for totally reflecting the light beams with incident angles within a preset range from the second LED unit 32 to the light emitting surface 360. The light beams are refracted by the light emitting surface 360, such that the light beams are gathered and the emitting angle of the light beams becomes narrower. In this way, the light beams from the second LED unit 32 are divided to several light groups and an aphotic area is formed between each two adjacent light groups.

Figure 5:
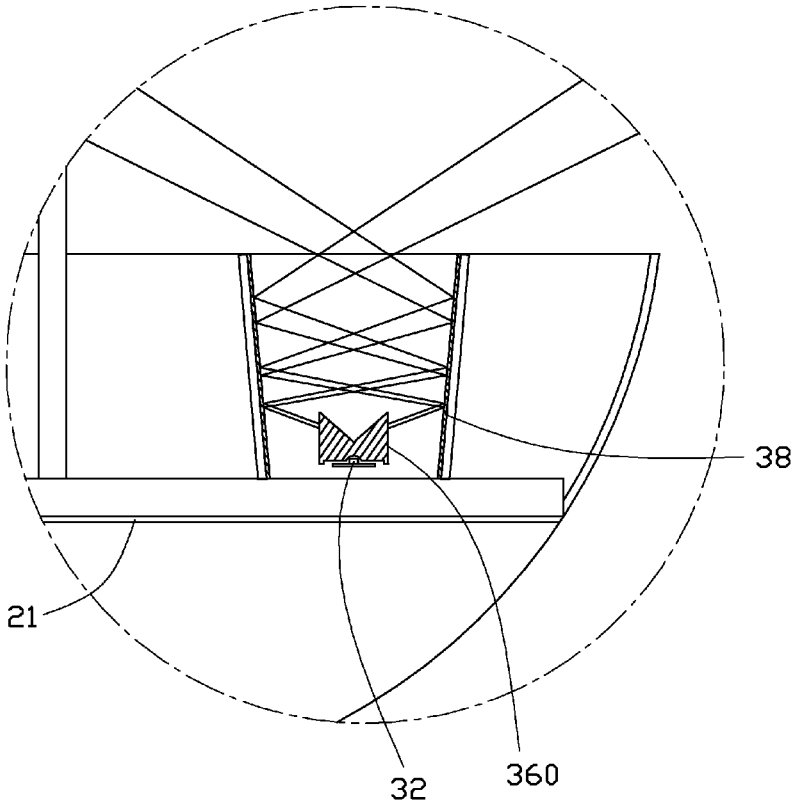
FIG. 5 is a schematic view of light paths illustrating light beams emitted from light emitting diodes pass through the lens in FIG. 1.
Figure 6:
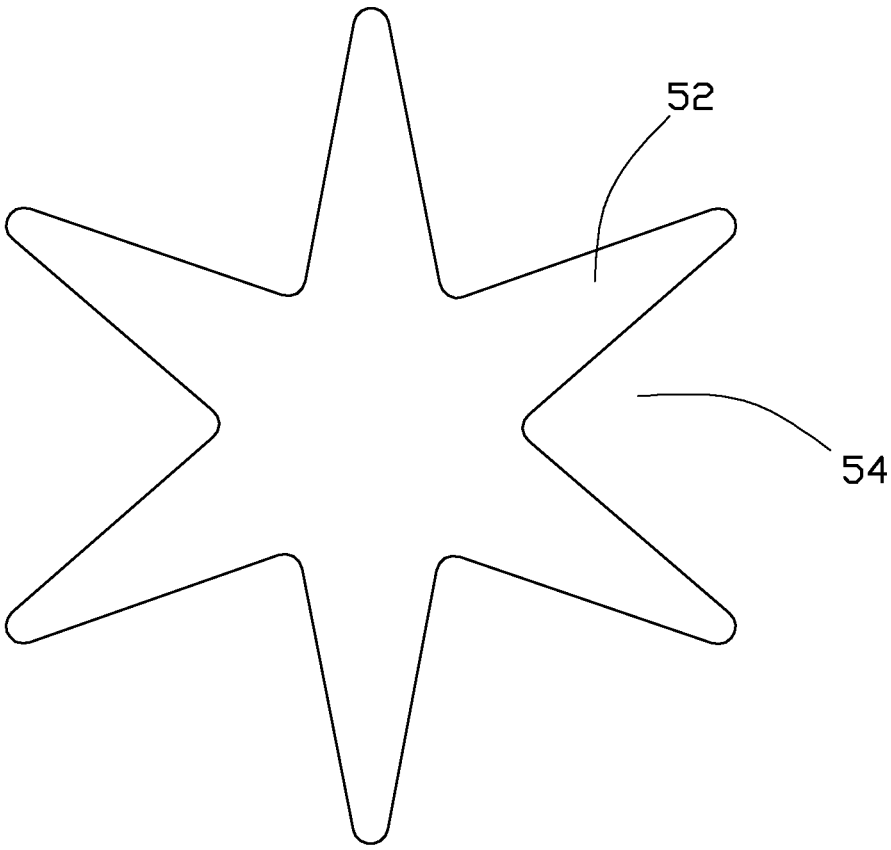
FIG. 6 is a schematic view of light beam shape formed on the ceiling by a lens of FIG. 3.

Referring to FIGS. 5 and 6, the light beams from the second LED unit 32 are refracted by the light emitting surface 360 and travel to the reflector 38. After being refracted several times, the light beams shine on the ceiling 50 and form luminescent bright areas 52. Because the two adjacent light groups, which enter the reflector 38 form the aphotic area, when the light beams are reflected by the reflector 38 to the ceiling 50, the aphotic areas 54 form a pattern. The luminescent bright area 52 and the aphotic area 54 are alternately arranged on the ceiling 50. Thus, a number of shaped light beams are formed on the ceiling 50.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED ceiling lamp comprising:

a primary illumination unit configured for illuminating; and at least one subsidiary illumination unit;

wherein the primary illumination comprises a base and a connecting member fixed to the base, a first circuit board with an LED unit thereon mounted on an opposite side of the base to the connecting member; each of the at least one subsidiary illumination unit is fixed to the base and faces the connecting member, and comprises a second circuit board with an LED unit, a lens and a reflector; the lens covers the second circuit board, the second circuit board and the lens are received in the reflector, the lens is a polyhedron prism and the lens defines an indentation at the end of the lens away from the circuit board, the indentation is formed with a plurality of inclined reflecting surfaces which are different in shapes and curves, the reflecting surface is configured for totally reflecting the light beams from the LED unit of the second circuit board with incident angle within a preset range from the LED units to the light emitting surface; the lens also includes a number of light emitting surfaces for focusing the light beams reflected by the reflecting surfaces, thereby the lens dividing the light beams into several light groups and an aphotic area is formed between each two adjacent light groups, the reflector is configured for reflecting the several light groups to a ceiling.

2. The LED ceiling lamp of claim 1, wherein the lens defines a recess and a cavity communicating with the recess at an end portion of the lens adjacent to the second circuit board, the recess is configured for receiving the second circuit board, the cavity is configured for receiving the LED unit of the second circuit board.

3. The LED ceiling lamp of claim 1, wherein each subsidiary illumination unit comprises a protecting case surrounding the reflector to protect the reflector.

4. The LED ceiling lamp of claim 1, wherein the primary illumination unit comprises a lampshade fixed to the base.

5. The LED ceiling lamp of claim 1, wherein the number of the subsidiary illumination unit is two, the subsidiary illumination units are symmetrically surrounding the connecting member.

* * * * *